United States Patent [19]

Muller

[11] 4,181,337

[45] Jan. 1, 1980

[54] DOOR HOLDING APPARATUS

[75] Inventor: Thomas P. Muller, Aurora, Ill.

[73] Assignee: Caterpillar Tractor Co., Peoria, Ill.

[21] Appl. No.: 878,635

[22] Filed: Feb. 17, 1978

[51] Int. Cl.[2] ..... E05C 17/04

[52] U.S. Cl. ..... 292/271; 16/2; 16/82; 403/71; 403/85

[58] Field of Search ..... 16/82, 83, 2, 108; 403/85, 70, 71; 292/271, 273, 274

[56] References Cited

U.S. PATENT DOCUMENTS

| | | | |
|---|---|---|---|
| 984,101 | 2/1911 | Millspaugh | 16/82 |
| 1,483,316 | 2/1924 | Seelinger | 16/82 |
| 1,597,274 | 8/1926 | Herrmann | 16/82 |
| 1,608,554 | 11/1926 | Goldsmith et al. | 16/82 |
| 1,852,905 | 4/1932 | Simpson | 16/82 |
| 3,295,158 | 1/1967 | Hotchkiss, Jr. et al. | 16/2 X |
| 3,619,482 | 11/1971 | Boor | 16/2 X |
| 3,679,249 | 7/1972 | Hoffmann | 403/71 X |
| 3,695,652 | 10/1972 | Ratnikas | 403/71 X |
| 3,768,115 | 10/1973 | Hoffmann et al. | 16/2 |
| 3,996,642 | 12/1976 | Atkins | 16/82 |

FOREIGN PATENT DOCUMENTS

| | | | |
|---|---|---|---|
| 2611622 | 9/1977 | Fed. Rep. of Germany | 403/71 |
| 7609018 | 11/1976 | France | 403/71 |

*Primary Examiner*—Werner H. Schroeder
*Assistant Examiner*—Moshe I. Cohen
*Attorney, Agent, or Firm*—Charles E. Lanchantin, Jr.

[57] ABSTRACT

A door holding apparatus holds a door in a preselected position relative to a door support. The apparatus includes a rod which has a first end pivotally connected to the door and a second end for engaging the door or door support. Force exerting apparatus exerts a force against the rod and urges the rod into forcible engagement with the door or door support.

4 Claims, 7 Drawing Figures

DOOR HOLDING APPARATUS

BACKGROUND OF THE INVENTION

Current vehicles, such as an excavator for example, are equipped with access doors to facilitate servicing of the vehicle. The doors are connected to the vehicle by hinges and swing open to allow access for servicing. The doors are susceptible to being blown closed by a gust of wind or by gravity where the vehicle rests on an uneven surface. Thus, a serviceman often has to hold the door open. It is desirable to have a door holding apparatus to hold the door open as required, in a stable manner.

A rod or bar has been used to hold automobile hoods open. Such rods merely act against gravity and are ineffective against forces acting normal to gravity, such as wind acting on the excavator door. Such rods merely support the hood and are ineffective against forces acting against gravity, such as an upward gust of wind.

It is desirable to have a door holding apparatus which holds the door open regardless of the direction of forces acting to close the door. It is also desirable that the holding apparatus be free of vibration when the machine operates with the doors closed to reduce noise. It is also desirable that the holding apparatus be of simple construction so that the doors are quickly and conveniently opened and closed.

SUMMARY OF THE INVENTION

The present invention is directed to overcoming one or more of the problems as set forth above.

According to the present invention, a door holding apparatus holds a door in a preselected position relative to a door support. The apparatus includes a rod for engaging with the door and door support. Apparatus is provided for exerting force against the rod and urging the rod into forcible engagement with one of the door and door support.

DETAILED DESCRIPTION

Figure 1:
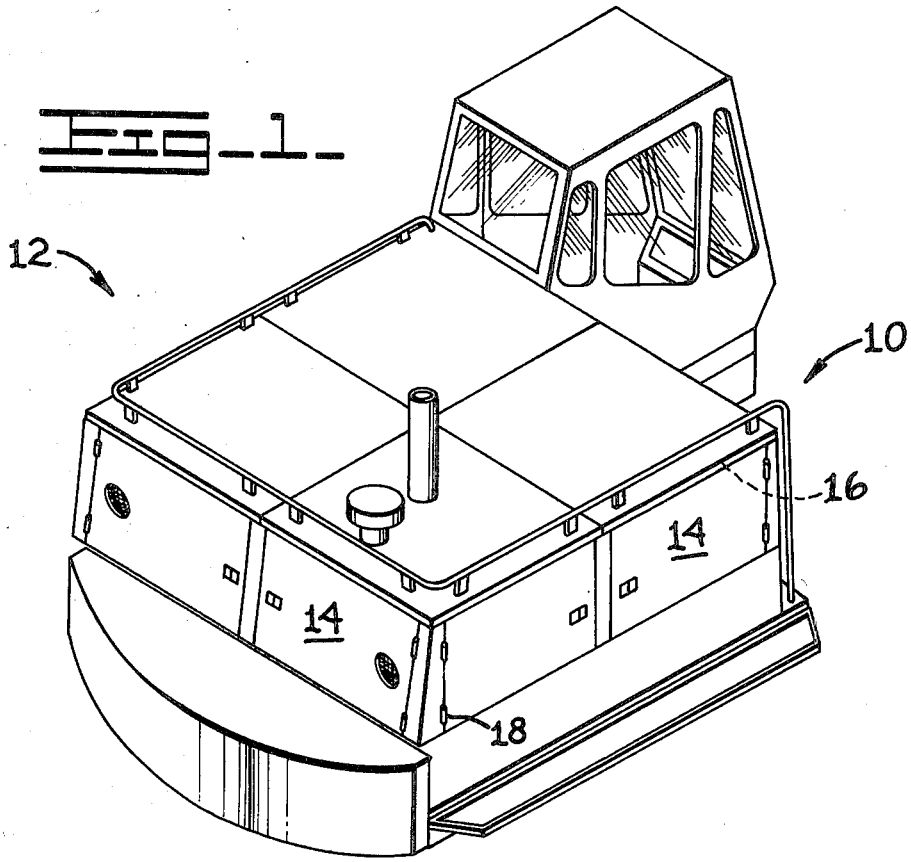
FIG. 1 is an isometric view of an excavator housing
Figure 2:
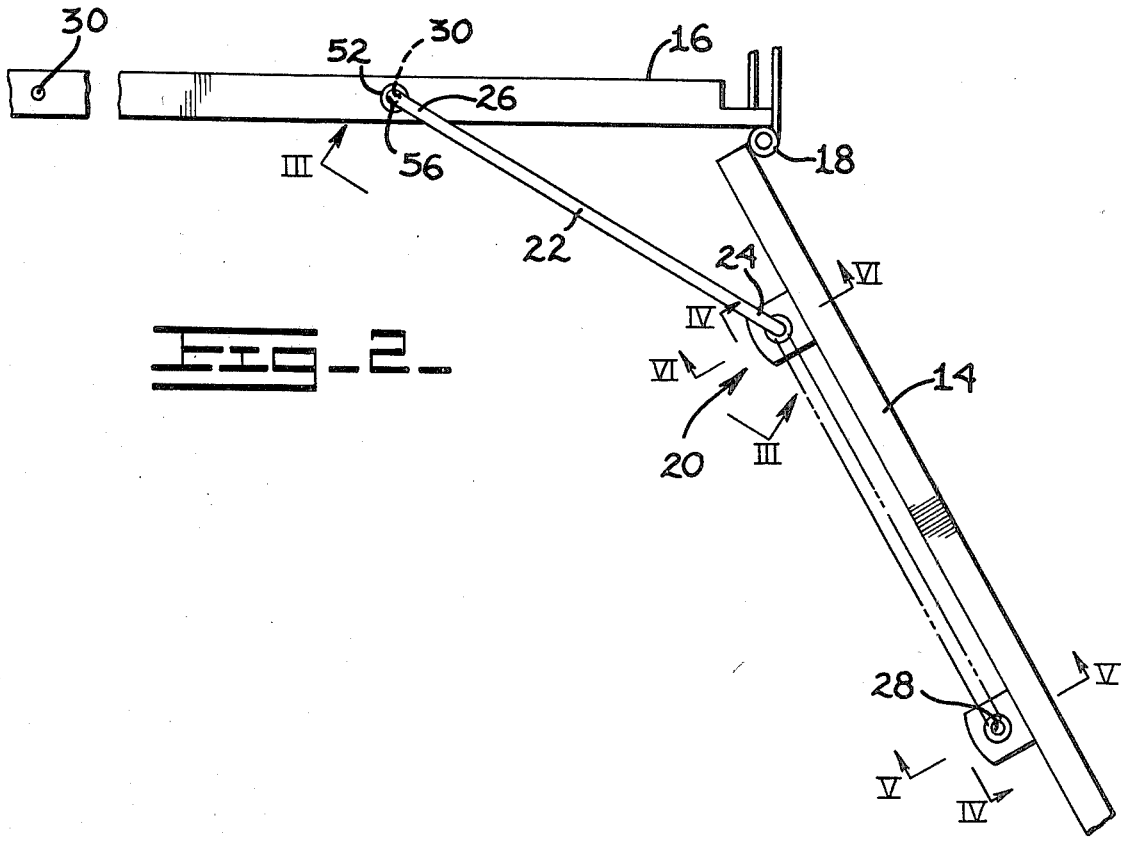
FIG. 2 is a partial plan view of the excavator with a door held open.

Referring to FIG. 1, a housing 10 of an excavator 12 has a plurality of service doors 14. Each door 14 is connected to a door support 16 by hinges 18 and is movable between a closed position (FIG. 1) and an open position (FIG. 2). A door holding apparatus 20 holds the door 14 in a preselected position relative to the door support 16 between the open and closed positions.

Figure 3:
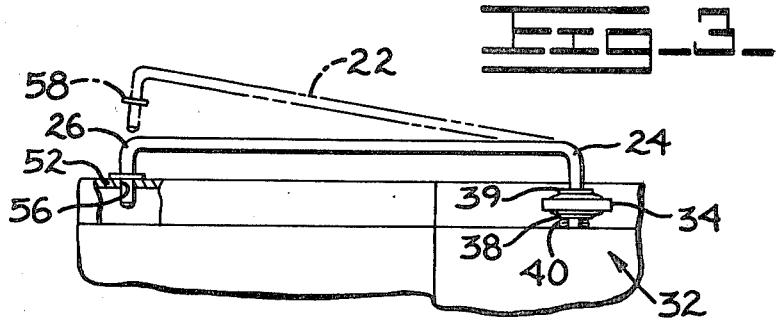
FIG. 3 is a view of the door taken along line III—III of FIG. 2.
Figure 4:
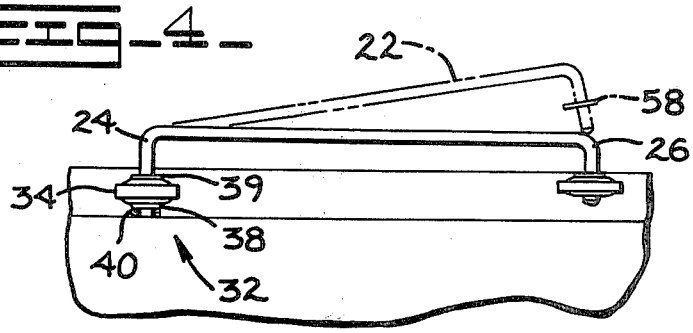
FIG. 4 is a view of the door taken along line IV—IV of FIG. 2.

Referring to FIG. 2, the door holding apparatus 20 includes a rod 22 which has first and second end portions 24, 26. The first end 24 is preferably pivotally connected to the door 14 and the second end 26 is preferably pivotally movable about the first end 24 between a storing position (FIG. 4) and a holding position (FIGS. 2 and 3). At the storing position, the second end 26 is engaging the door 14 and at the holding position the second end 26 is engaging the door support 16. The rod 22 can be pivotally connected to the door support 16 for pivotal movement between the storing and holding positions. Thus, at the storing position the second end 26 engages the door support 16 and at the holding position the second end 26 engages the door 14.

The door 14 and door support 16 have one or more apertures 28, 30, respectively, for receiving the second end 26 of the rod 22. The apertures 28, 30 facilitate positioning the rod 22 for holding the door 14 at selected positions between the open and closed positions. By this construction, a servicemen can select the door position most suitable for the environment and the service to be performed.

Referring to FIGS. 2–4 and 6, the door holding apparatus 20 includes a means 32 for exerting force against the rod 22 and urging the rod 22 into forcible engagement with the door 14 and door support 16. The force exerting means 32 includes an elastomeric grommet 34 which has an opening 36 and is of a size and configuration sufficient for exerting force on the rod 22 and urging the rod 22 into forcible engagement with the door 14 and door support 16. By this construction, the rod 22 forcibly holds the door 14 in the preselected position irrespective of the forces acting on the door 14 tending to close the door 14.

The grommet 34 is preferably positioned about the first end 24 of the rod 22 and exerts force on the first end 24 and urges the second end 26 into forcible engagement with the door apertures 28 or door support aperture 30. The grommet 34 is held on the rod 22 by first and second washers 38, 39 and a pin 40. The pin 40 protrudes through an opening 42 in the first end 24 and the washer 38 rests between the pin 40 and grommet 34. The force exerted by the grommet 34 is determined by the positions of the pin 40 and washers 38, 39. The tighter the pin 40 holds the first washer 38 against the grommet 34, and the closer the fit between the rod 22 and the grommet 34, the higher the force exerted by the grommet 34 on the second washer 39 and the rod 22.

Figure 7:
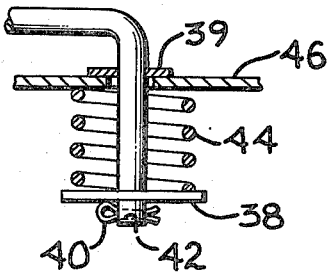
FIG. 7 is a view similar to FIG. 6 but showing an alternate embodiment of the present invention.

Referring to FIG. 7, a spring 44 can be used instead of the elastomeric grommet 34. The grommet 34 is preferred because it generates less noise than the spring 44 and can exert forces on the rod 22 in different manners and directions.

Figure 6:
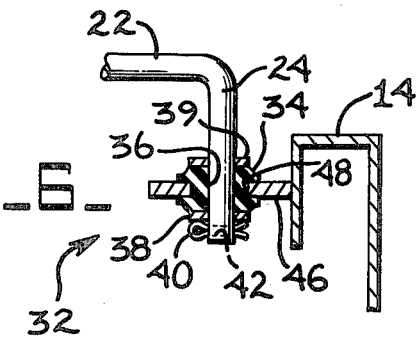
FIG. 6 is a view taken along line VI—VI of FIG. 2.

Referring to FIGS. 2 and 6, the grommet 34 is preferably connected to a bracket 46. The bracket 46 is preferably connected to the door 14 and has an aperture 48 through which the grommet 34 and rod 22 extend. The grommet 34 has a construction sufficient for a portion of the grommet 34 to extend through the bracket aperture 48 with a portion abutting the bracket 46. Thus, the grommet 34 is positioned between the washers 38, 39 and bracket 46.

Figure 5:
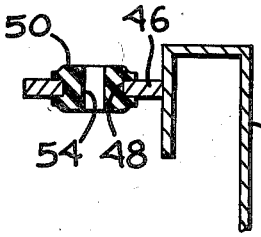
FIG. 5 is a sectional view taken along line V—V of FIG. 2.

Elastomeric grommets 50, 52 are positioned in the door and door support apertures 28, 30 respectively. Each of the grommets 50, 52 has an opening 54, 56 of a size sufficient for forcibly engaging the second end 26 of the rod 22 and maintaining the second end 26 free from contact with the door 14 or door support 16. A plate or washer 58 is fixedly attached to the second end 26 and limits the travel of the (FIG. 5) second end 26 into the grommets 50, 52. By this construction, metal to metal contact of the rod 22 with the door 14 or door support 16 is avoided and the rod 22 securely holds the door 14 open.

In operation, the servicemen opens the door 14 and lifts the second end 26 of the rod 22 from the stored position The second end 26 is pivoted about the first end 24 to the holding position. The rod 22 is aligned with one of the door or door support apertures 28, 30 and released. The rod 22 engages one of the grommets 50, 52 and holds the door 14 open. Because the rod 22 is secured on each end, the door 14 is held open in a stable manner regardless of the direction of the forces acting to close the door 14 and the rod 22 does not rattle or vibrate.

Other aspects, objects and advantages will become apparent from a study of the specification, drawings, and appended claims.

The embodiments of the invention in which an exclusive property or privilege is claimed are defined as follows:

1. An apparatus (20) for holding a door (14) having a first aperture (48) in a preselected position relative to a door support (16) having a second aperture (30), comprising:

a U-shaped rod (22) having a midsection and opposite first and second ends (24,26), each end (24,26) having an axis substantially normal to the midsection;

first resilient grommet means (50) for receiving said second end (26) of the rod (22) and being disposed in a selected one of said first and second apertures (48,30); and second resilient grommet means (32) for holding said first end (24) of the rod (22); permitting pivotal movement thereof, and exerting force against said first end (24) substantially in the direction of its longitudinal axis and urging said second end (26) substantially in the direction of its longitudinal axis and positively into forcible engagement with the first resilient grommet means (50), said second resilient grommet means (32) being disposed in the other one of said first and second apertures (48,30).

2. The apparatus (20) of claim 1, further comprising:

first shoulder means (39) connected to said first end (24) of the rod (22) for limiting movement thereof into said other one of said apertures (48,30); and second shoulder means (38,40) releasably connected to said first end (24) of the rod (22) for limiting movement thereof out of said other one of said apertures (48,30), said first and second shoulder means (39,38,40) bearing against said second resilient grommet means (32) and defining the forces exerted axially on the first end (24) of the rod (22).

3. The apparatus (20) of claim 2, further comprising:

third shoulder means (58) connected to said second end (26) of the rod (22) for limiting movement thereof into said selected one of said apertures (48,30).

4. The apparatus (20) of claim 3 wherein said first and third shoulder means (39,58) each include a washer (39,58) individually connected securely to said first and second ends (24,26) of the rod (22).

* * * * *